United States Patent [19]

Mori et al.

[11] Patent Number: 4,601,434

[45] Date of Patent: Jul. 22, 1986

[54] PACKAGE TRANSPORTING APPARATUS

[75] Inventors: Shigeki Mori, Ohtsu; Akihiro Itoi; Yoshiyuki Ichiba, both of Kyoto, all of Japan

[73] Assignee: Murata Kikai Kabushiki Kaisha, Japan

[21] Appl. No.: 605,787

[22] Filed: May 1, 1984

[30] Foreign Application Priority Data

May 3, 1983 [JP] Japan ..... 58-78587

[51] Int. Cl.[4] ..... B65H 49/00; B65H 67/02; B65H 67/06

[52] U.S. Cl. ..... 242/35.5 A; 242/35.6 E; 242/164; 226/92

[58] Field of Search ..... 242/35.5 A, 35.5 R, 242/18 R, 18 EW, 164, 165, 129.5, 130, 130.3, 130.4, 131, 131.1, 125, 125.1, 125.2, 125.3, 159, 35.6 R, 35.6 E; 57/279

[56] References Cited

U.S. PATENT DOCUMENTS

| | | | |
|---|---|---|---|
| 3,295,775 | 1/1967 | Raasch et al. | 242/35.5 R |
| 3,913,853 | 10/1975 | Raasch | 242/35.5 A |
| 4,432,198 | 2/1984 | D'Agnolo | 242/35.5 A X |
| 4,463,909 | 8/1984 | Kiriake et al. | 242/35.5 A |

*Primary Examiner*—Stanley N. Gilreath

*Attorney, Agent, or Firm*—Spensley, Horn, Jubas & Lubitz

[57] ABSTRACT

An apparatus for transporting a package doffed by a spinning frame to a winder. Packages are independently transported on a package supply conveyor by means of a peg tray which includes a guide member for securing thereto an end of a yarn extracted from the package. The package carrying tray is delivered to a frictionless inclined pathway and proceeds under its own weight to a winding position adjacent a winding unit.

3 Claims, 5 Drawing Figures

PACKAGE TRANSPORTING APPARATUS

BACKGROUND OF THE INVENTION

1. Field of the invention

This invention relates to an apparatus for transporting a package doffed by a spinning frame to a winder.

2. Prior Art

Commonly, a cop produced by a spinning frame, particularly a spinning yarn produced by a ring spinning machine, is wound up into a bobbin, that is, doffed into a so-called fine spinning cop, which is then rewound, at a subsequent rewinding step, that is, by means of a winder, into a package of a predetermined configuration on which a yarn having any defect removed therefrom is wound in a predetermined quantity. In this instance, a plurality of cops are used in order to obtain a single package due to the fact that the quantity of a yarn on a cop is relatively small. Accordingly, exchanging operations of cops are accomplished very frequently, and thus, each winding unit of a winder is provided with a device called a magazine for storing a plurality of cops therein so that one of cops stored in the magazine may be released and supplied onto a peg on the winding unit immediately after a layer of a yarn on a cop during rewinding has been unwound completely therefrom.

Meanwhile, a package which is doffed by a rotor type open end spinning frame, a pneumatic spinning frame utilizing a vortex flow of air, or the like, has a yarn in a large quantity and is thus called a large package. Such a large package has a diametrical dimension which is as large as several to ten times of that of a cop produced on a ring spinning frame.

It is very difficult to provide a winding unit with a magazine for storing large packages therein in order to rewind such large packages, that is, it is difficult for a magazine to store a plurality of large packages which have a dimetrical dimension substantially equal to the width of the winding unit. Even if this is possible, it is still impossible to store packages in a winding unit except that a few packages can be stored one on another in front of the winding unit. Thus, replacement of packages is normally accomplished for a required winding unit manually by an operator while he travels round winding units. Accordingly, a number of winders cannot be allotted to an operator, and hence an operating efficiency is held low, resulting in a low working efficiency of winders.

SUMMARY OF THE INVENTION

An object of the present invention is to provide an apparatus for efficiently supplying packages to winding units for rewinding yarns thereof without additional provision of a magazine to each winding unit.

According to the present invention, packages are transported on a package supply path by means of a peg tray which includes a guide member for securing thereto an end of a yarn extracted from a package erectly fitted on the peg tray being transported independently, the guide member being disposed at the center of a peg tray such that it can protrude upwardly from the peg tray with the yarn end secured thereto at a fixed station of a winding unit.

DETAILED DESCRIPTION OF THE INVENTION

Now, a preferred embodiment of the present invention will be described with reference to the accompanying drawings.

Figure 1:
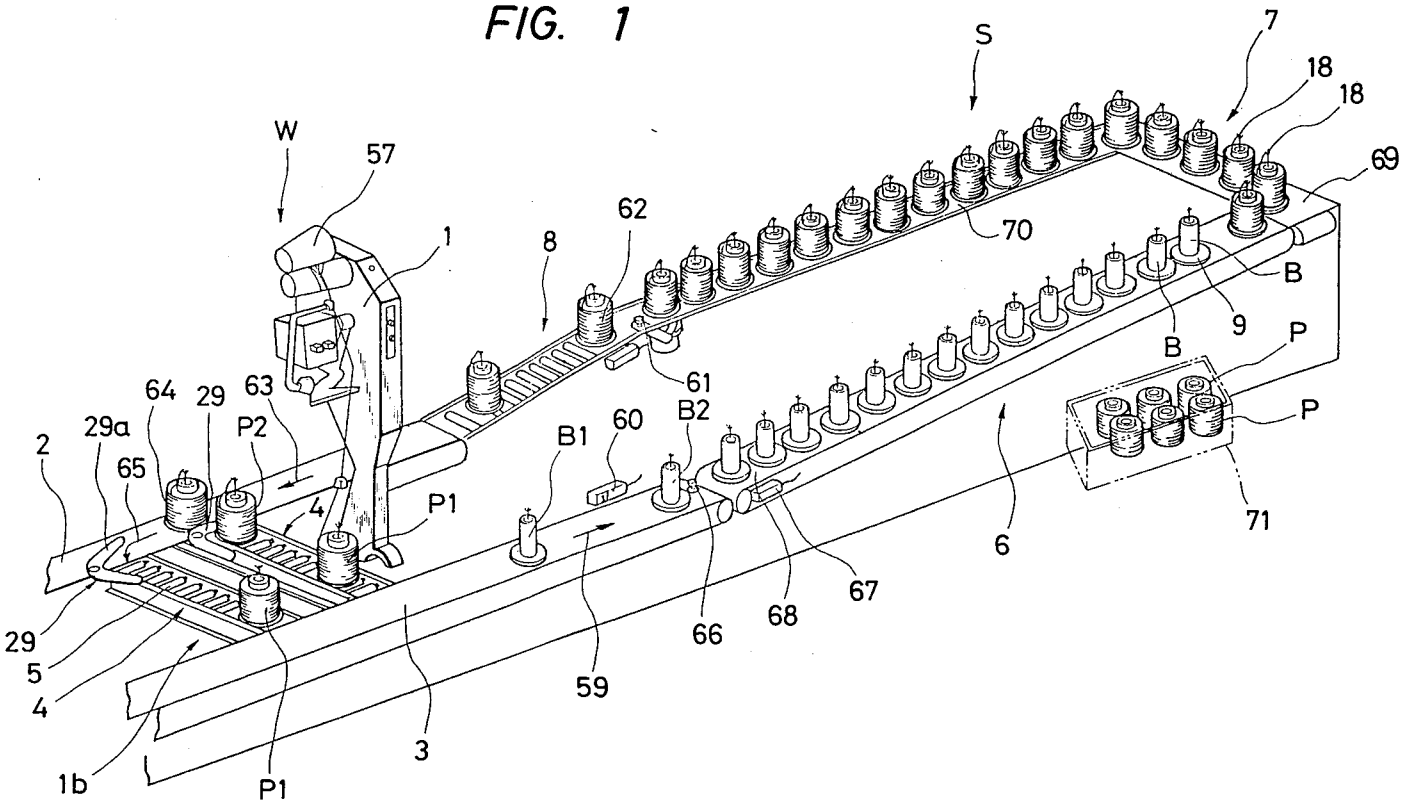
FIG. 1 is a perspective view showing a general construction of a package transporting system to which an apparatus according to the present invention is applied.

Referring to FIG. 1 which illustrates an example of a package transporting apparatus to which the present invention is applied, a winder W is shown which includes a number of winding units 1 arranged in a row. A package supply path 2 constituted from conveyor belts and so on extends along one side of the row of the winding units 1 of the winder W while an empty bobbin returning path 3 constituted from conveyor belts and so on extends along the other side of the row of the winding units 1 of the winder W. A package path 4 constituted from a roller conveyor 5 and so on is disposed at a position adjacent each of the winding units 1 and extends between the package supply path 2 and the empty bobbin returning path 3. Adjacent an end of the row of the winding units 1 of the winder W, a tray storing section S constituted from a conveyor belt and so on is provided in contiguous relationship to the empty bobbin returning path 3 at an end thereof and also to the package supply path 2 at the other end thereof. The conveyor constituting the tray storing section S includes an inclined portion 6 contiguous to the empty bobbin returning path 3, a horizontal portion 7, and another inclined portion 8. The horizontal portion 7 of the tray storing section S is located at a height for convenience of operations by an operator.

Figure 2:
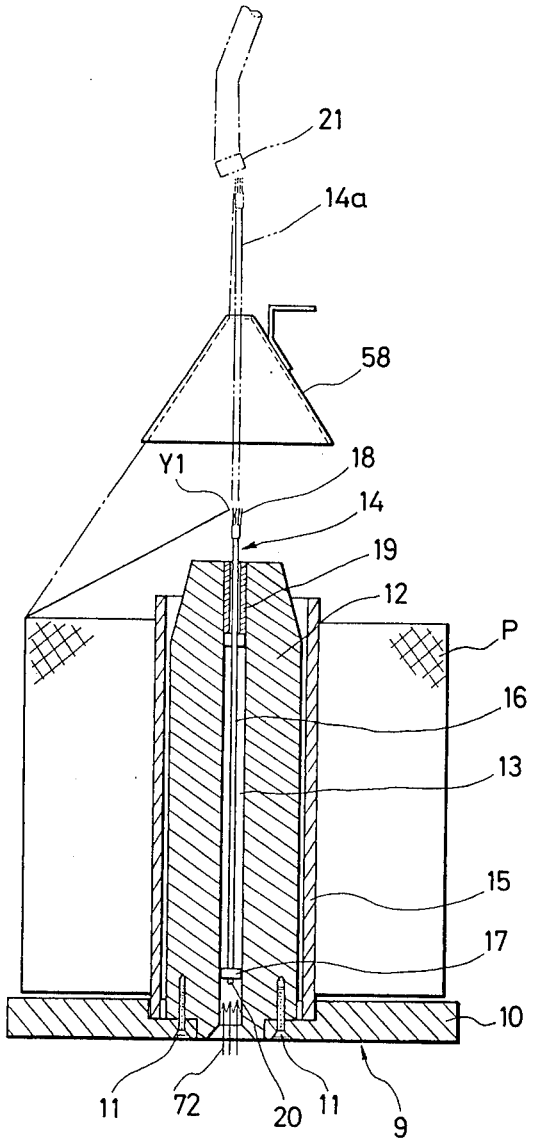
FIG. 2 is a front elevational sectional view showing an embodiment of a peg tray.

A tray constituting a package transporting medium which is transported along such transporting and storing paths as described above will now be described with reference to FIG. 2. A tray 9 includes a base plate 10 in the form of a disk, a peg 12 in the form of a cylinder extending erectly from the center of and secured to the base plate 10 by means of a bolt 11, by soldering or the like, a yarn guide 14 inserted for up and down or vertical sliding movement in a center hole 13 of the peg 12, and so on. The base plate 10 is in the form of a disk which has a diameter that is at least greater than a possible maximum diameter of a package P which may be fitted thereon while the peg 12 has a diameter which is sufficiently large to allow a bobbin 15 of a package P to be fitted smoothly thereon and an overall height which is substantially equal to the height of the package. The center hole 13 perforated in the center of the peg 12 extends from the top to the bottom end of the peg 12 so that the yarn guide 14 inserted in the center hole 13 may be moved upwardly by means of compressed fluid jetted into the center hole 13 from below the base plate 10. The yarn guide 14 includes an elongated rod 16 which has a piston 17 fixedly mounted at a lower end thereof and a yarn grip 18 for securing an end of a yarn provided at an upper end thereof. The yarn grip 18 may be constituted, for example, from a brush, a piece of felt, or the like. Upper and lower end stoppers 19 and 20 for stopping the yarn guide 14 are secured adjacent the top and bottom ends of the center hole 13 of the peg 12, respectively. The yarn guide 14 is designed to have a sufficient length to allow, when it is protruded upwardly to its maximum extent from the peg 12, the yarn grip 18 at the top end thereof to come to a position adjacent a suction hole of a suction pipe 21 waiting on the winding unit in order that an end Y1 of a yarn secured to the grip 18 may be sucked into the suction pipe 21 to allow separation of the yarn end and the grip 18 from each other. Accordingly, if the upper stopper 19 is formed into a screw, then the relative position of the stopper 19 can be adjusted to allow the extent of protrusion of the yarn guide 14 to correspond with the suction pipe 21 of the winding unit.

The yarn guide 14 may be protruded upwardly either by compressed fluid jetted into the center hole 13 of the peg 12 through the opening at the lower end of the yarn guide 14 as described hereinabove or, where there is a sufficient spacing below the tray 9, by a pushing up rod which is advanced into the center hole 13. The yarn guide 14 may be returned from the protruded to the initial position by its own weight when supply of the compressed fluid is stopped. It is also possible to interpose a coil spring between the upper and lower stoppers 19 and 20 in order to provide an initial force for returning the yarn guide 14.

Figure 3:
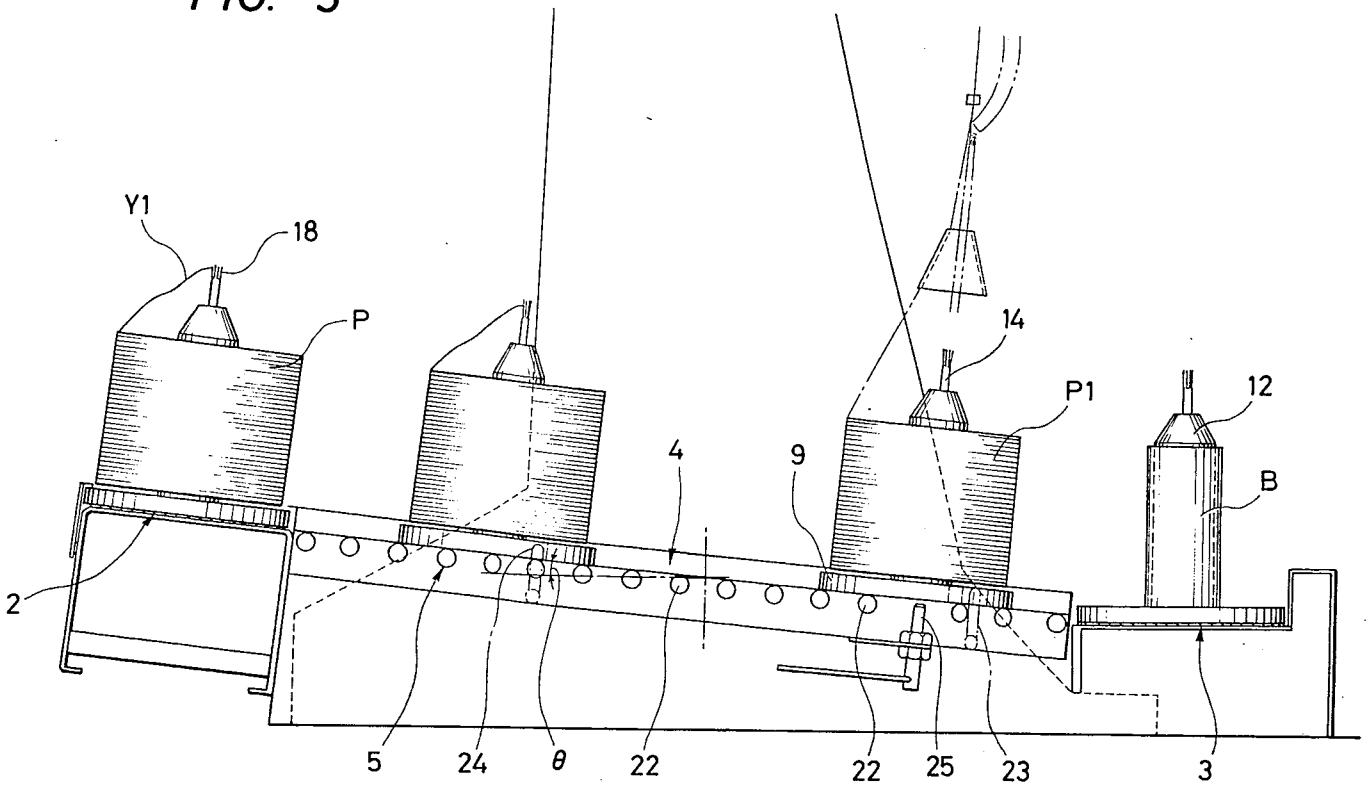
FIG. 3 is a side elevational view of a tray path for a winding unit.

Now, description will be given with reference to FIGS. 3 to 5 of structure of a tray path in a winding unit which is applied for taking in a package transported by means of such a peg tray 9 as described above and for discharging an empty bobbin after a yarn has been rewound from the package while it is held fitted on the tray. Referring first to FIG. 3, the path 4 for each winding unit extending between the package supply path 2 and the empty bobbin returning path 3 is constituted from a roller conveyor 5 which mainly includes a plurality of free rollers 22. A tray receiving plane provided by top faces of the rollers 22 is inclined toward the returning path 3 from the supply path 2 so that a package taken in from the supply path 2 may slip, due to its own weight, on the roller conveyor 5 to a winding position P1, from which an empty bobbin may be discharged onto the returning path 3 by its own weight when a stopper is released. An angle $\theta$ of inclination of the roller conveyor 5 is determined in connection with the readiness of slipping movement of trays, the running direction of a yarn unwound at a winding position, and so on, and is about 5 degrees. Also, the package supply path 2 is arranged in the same angle of inclination with the path 4 in the widthwise direction thereof so as to facilitate taking in of packages from the supply path 2 to the tray path 4 of each winding unit.

Positioning of packages P at a winding station and at a standby station is performed by means of stoppers 23 and 24, respectively, which are each provided for engagement with a tray at such a station and thus on each of the paths 4, there always exist two packages including one from which a yarn is being unwound and another one which is prepared for subsequent unwinding of a yarn thereof. At a position a little below the top plane of the roller conveyor 5 at the winding station P1, a compressed air jetting nozzle 25 is provided for causing the yarn guide 14 to protrude upwardly from the peg 12 of the tray 9 as described hereinabove.

Figure 4:
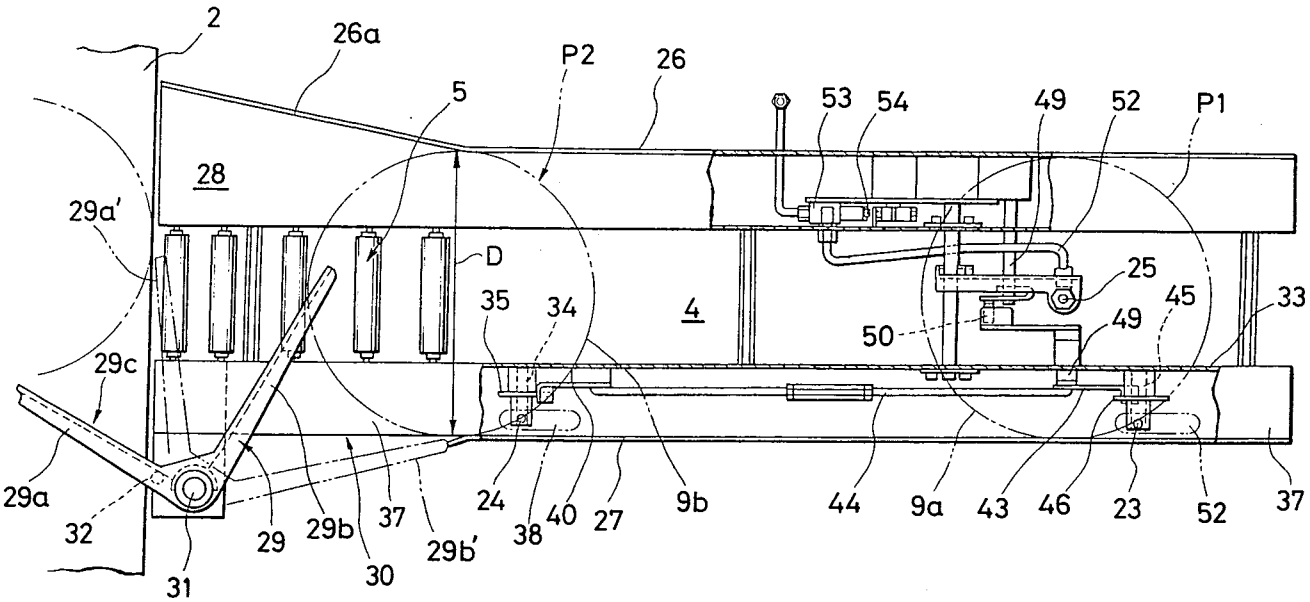
FIG. 4 is a plan view of the tray path of FIG. 3.
Figure 5:
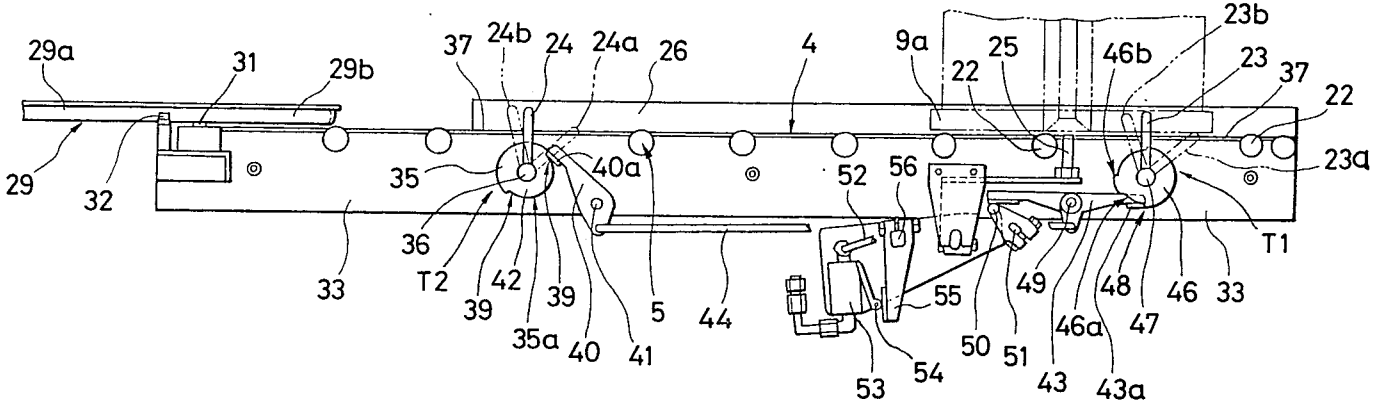
FIG. 5 is a side elecational view showing an example of stoppers for a tray and a releasing device.

Feferring now to FIGS. 4 and 5, the path 4 has a substantially same width as the diameter D of the tray 9, and guide plates 26 and 27 are secured adjacent opposite sides of the path 4. One of the guide plates 26 is bent to expand laterally at a portion 26*a* thereof adjacent a taking in entrance 28 so as to allow a tray 9 to be smoothly taken into the path 4. The other guide plate 27 has, in opposition to the portion 26*a*, a cutout portion 30 so as to allow a pivotal motion of a taking in lever 29.

The tray taking in lever 29 provided at a position on the downstream side of the supply path relative to the taking in entrance 28 is in the form of a substantially V-shaped lever which is mounted for pivotal movement about a pivot 31, and a spring not shown urges the taking in lever 29 in a counterclockwise direction about the pivot 31 of FIG. 4 to a standby position for taking in a package in which an arm 29*a* thereof is abutted against a stop 32. In particular, when the taking in lever 29 is positioned at a position as shown in full lines of FIG. 4, if there is no package present at the standby station on the tray path 4, the arm 29*a* of the lever 29 extends transversely above the supply path 2 so that a tray for a package transported thereto along the path 2 will be stopped by the thus extending arm 29*a* of the taking in lever 29. The package is then moved onto the tray path 4 along an inclined face 29*c* of the arm 29*a* due to a circulating force of the conveyor belt. After being transferred onto the path 4, the package is slipped on the roller conveyor 5 by its own weight due to inclination of the path 4 while it pivots the taking in lever 29 in a clockwise direction until the tray comes to a position in which it is abutted against the stopper 24. It is to be noted here that, since the base plate 10 of a tray P taken in and having a package fittedly supported thereon is held abutted at an outer peripheral face thereof with the other arm 29*b* of the taking in lever 29 at a position designated at 29*b*′ while the package P is held positioned at the standby station P2 on the path 4, the first-mentioned arm 29*a* of the lever 29 is positioned, against the urging of the spring, to a two dots and dash position designated at 29*a*, that is, to a position retracted into an area above the path 4 without extending over the supply path 2. Accordingly, a following package transported on the supply path 2 will pass by the winding unit and advance to a next winding unit which requires a package.

Description will now be given of the stoppers 23 and 24 provided in the path 4 for positioning trays to fixed positions and for releasing them therefrom.

Referring to FIGS. 4 and 5, the stopper 24 has a cam plate 35 and a cylinder 36 integrally formed therewith and extends radially from the cylinder 36. The stopper 24 is mounted for pivotal movement about a pivot 34 secured to a frame 33 and is urged in a counterclockwise direction in FIG. 5 together with the cam plate 35 by means of a spring not shown. The stopper 24 can protrude upwardly above a flat plate 37 of the path 4 through an elongated slot 38 perforated in the flat plate 37 and also can recede below the flat plate 37. A stop lever 40 is supported for pivotal movement about a pivot 41 into and out of engagement with a shoulder 39 of the cam plate 35 and is operatively connected to a stop lever 43 of another cam plate 46 at the winding position by means of a connecting rod 44. A stopper mechanism T1 similar to the stopper mechanism T2 as described above is provided also at the winding station P1. In particular, a cam plate 46 and the stopper 23 on a cylinder 47 are supported for integral rotation on a fixed shaft 45, and the stop lever 43 is supported for pivotal movement about a pivot 49 into and out of engagement with a shoulder 48 of the cam plate 46. The stop lever 43 extends through the frame 33, and an actuating lever 50 disposed for engagement with the other end of the stop lever 43 to operate the lever 43 is secured to a rotary shaft 51 which operates in response to an instruction from the winding unit. Thus, when the stop levers 23 and 24 are in positions as respectively shown in full lines in FIG. 5 and hence the levers 43 and 40 are engaged at engaging portions thereof with shoulders of the cam plates 46 and 35, respectively, packages taken into the path 4 will be stopped at the stopper positions. After then, when the actuating lever 50 is pivoted over a fixed angle in the clockwise direction in FIG. 5 together with the shaft 51 in response to an instruction from the winding unit, the levers 43 and 40 are disengaged from the cam plates 46 and 35, respectively, and as trays 9*a* and 9*b* on the inclined path are thus slipped toward the returning path, the stoppers 23 and 24 are retracted to positions 23*a* and 24*a* as shown in two dots and dash lines in FIG. 5, that is, below the trays until the trays pass thereby. Thus, an empty bobbin after completion of unwinding of a yarn therefrom is discharged onto the returning path 3 and the next package at the standby station P2 is allowed to come to the winding station.

It is to be noted that, just after trays have passed over the stoppers 23 and 24, the stoppers 23 and 24 are each pivoted in the counterclockwise direction by the urging of the associated spring until they are brought to respective positions 23*b* and 24*b* as shown in two dots and dash lines in FIG. 5 in which they are each pressed against that one of ends of the slot 52 or 38 in the flat plate 37 which is nearer to the supply path 2. At this instant, the actuating lever 50 is already returned to its initial position and the engaging portions of the stop levers 43 and 40 are abutted against smaller diameter portions 46*a* and 35*a* of the cam plates 46 and 35, respectively, by means of respective springs associated therewith. Accordingly, if new trays come to the stopper positions in this condition, they will push the stoppers 23 and 24 to pivot them together with the cam plates 46 and 35 in the clockwise direction, respectively, until the stoppers 23 and 24 are brought to the respective full line positions at which the engaging portions 43*a* and 40*a* are engaged with the shoulders of the cam plates 46 and 35 to positively stop the cam plates 46 and 35, respectively. As a result, the stoppers 23 and 24 are also positioned to the respective full line positions thereby to position the new packages to the winding station and the standby station.

It is also to be noted that a cam lobe 46*b* formed on the cam plate 46 at the winding station enables, when there is no package present at either of the winding and the standby stations, a package which is taken into the tray path 4 to be fed to the winding station P1 at a stroke without being stopped at the standby station P2. In particular, when there is no package present at either of the winding and the standby stations, the stoppers 23 and 24 are held to their respective two dots and dash line positions 23*b* and 24*b* due to the urging of their respective associated springs and hence the stop lever 43 is abutted by the cam lobe 46*b* of the cam plate 46, thereby positioning the lever 40 connected to the stop lever 43 by way of the rod 44 to a position in which the engaging portion 40*a* thereof is disengaged from the shoulder 39 of the plate cam 35. Accordingly, in this condition, a package taken in from the supply path is slipped on the roller conveyor 5 due to the inclination of the tray path 4 and passes the stopper 24 while it pushes the stopper 24 to pivot from the two dots and dash line position 24*b* to the other two dots and dash line position 24*a*. The package further advances until it is engaged with the stopper 23 at the two dots and dash position 23*b* in the winding station to pivot the stopper 23 and the cam plate 46 in the clockwise direction. Upon this pivotal motion of the cam plate 46, the engaging portion 43*a* of the stop lever 43 is disengaged from the cam lobe 46*b* of the cam plate 46 and the stop lever 43 is thus pivoted into engagement with the small diameter cam portion 46*a* of the cam plate 46 by the urging of the spring. The pivotal motion of the cam plate 46 is stopped when the stop lever 43 is engaged at the engaging portion 43*a* thereof with the shoulder 48 of the cam plate 46 to thus position the stopper 23 to the full line position together with the cam plate 46.

The compression air jetting nozzle 25 located below the tray path 4 in the winding station P1 is disposed between adjacent two rollers 22 and has a compression air supply pipe 52 connected thereto. The compression air supply pipe 52 is in turn connected to a supply source via a change-over valve 53. A lever 55 for rendering an a actuator 54 for the change-over valve 53 operative is secured to a rotary shaft 56 which is operated at a suitable time by a drive mechanism of the winding unit.

Operations of the package transporting system which includes such components as described hereinabove will be described below.

Referring to FIG. 1, after completion of unwinding of a yarn of a package in the winding station of a winding unit 1*b*, an instruction is issued from the winding unit to release the stopper 23. Consequently, the tray which thus has an empty bobbin fitted thereon slips to move on the roller conveyor 5 by its own weight and is discharged onto the returning path 3 while a package at the standby station is allowed to advance to the winding station. In this position, the yarn guide 14 to which a yarn end Y1 released from the package P is secured is lifted by compressed air 72 jetted from the compressed air jetting nozzle to protrude upwardly to a two dots and dash line position 14*a* as seen in FIG. 2. At this position 14*a* of the yarn guide 14, the yarn end Y1 is sucked into and grasped by the suction pipe 21 waiting in position and is thus introduced into a knotter by which means it is knotted with an end of another yarn drawn out from a winding package (designated at 57 in FIG. 1) on the winding unit, thereby allowing a winding operation to be restarted. However, in the case of a large package P, the yarn end Y1 is relatively thick and has a relatively large mass, and accordingly in a conventional system in which a yarn end is suspended in the center hole 13 of a peg and is blown up therefrom, the yarn end may not reach the position of the suction pipe 21 or else the yarn end may be blown up in a varying direction due to a large diameter of the package P, resulting in liability to suction error of the suction pipe: on the contrary, according to the apparatus of the present invention, since the yarn guide 14 is protruded with a yarn end secured thereto, the yarn end secured to the grip 18 at the top of the yarn guide can thus assuredly reach the position of the suction pipe 21 and thus be sucked into and grasped by the suction pipe 21. Reference numeral 58 designates a balloon guide.

Referring again to FIG. 1, the empty bobbin B1 discharged onto the returning path 3 is fed in the direction indicated by an arrow mark 59 and thus passes by a detector 60. The detector 60 may be, for example, a photoelectric sensor and detects passage of an empty bobbin B1. Each time passage of an empty bobbin B1 is detected by the detector 60, a releasing device 61 located at an end of the storing station is operated to release therefrom one package 62, which is thus supplied onto the supply path 2. As a package 64 which is fed on the supply path 2 in the direction indicated by an arrow mark 63 thus comes to the position of the winding unit 1*b* which has discharged the empty bobbin B1, it is abutted with the arm 29*a* of the taking in lever 29 in its waiting position and is prevented from advancing straightforwardly. As a result, the package 64 is taken in onto the path 4 as shown by an arrow mark 65 due to the circulating force of the conveyor 2 and the inclination of the conveyor itself. Since at this instant the stopper in the standby station in the tray path 4 is positioned at the two dots and dash line position 24*b* in FIG. 5, as a result of taking in and slipping movement of the package, the tray on which the package is supported is engaged with and pivots the stopper 24 to the full line position as described hereinabove. The package is thus stopped at and positioned to the standby station P1 as seen in FIG. 3. In the meantime, since the taking in lever 29 is held positioned to the two dots and dash line position 29*b* in FIG. 4 by the tray 9*b*, any following package will pass by the already occupied winding unit and will be transported to another winding unit which requires a package.

Referring again to FIG. 1, an empty bobbin B2 which has passed the detector 60 is once stopped at the position of a movable stopper 66. Here, if a vacant seat detector 67 detects that there is no empty bobbin present on the conveyor 68 adjacent the position of the detector 67, that is, if the detector 67 detects a vacant seat, the movable stopper 66 is released to allow the empty bobbin B2 to be transported into the storing station 6 without being collided with empty bobbins already stored therein. Empty bobbins B fed back one after another in this way are thus stored in the storing station S, and while they are fed on conveyors 68, 69 and 70, they are replaced with packages P stocked in a stock station 71 by an operator. In particular, an operator will pull an empty bobbin B off the peg of a tray 9, take out a new package P from the package stock station 71, fit it on the peg of the tray 9, pick up an end of a yarn on the package thus fitted, and secure the thus picked up yarn end to the yarn grip 18 at the center of the bobbin. A package P having an end of a yarn led in this way thereon is stored in the storing station S while it is fitted on a tray. Replacement of bobbins described above may be accomplished, in place of by an operator, otherwise by a robot, a mainpulator or the like. In such cases, it is necessary to provide means for stopping a tray at a fixed position in the storing station and to locate the package stock 71 at a fixed position.

It is to be noted that the system has been illustrated and described wherein a new package is supplied to the supply path 2 each time an empty bobbin discharged is detected, but if the system is modified such that the supply path 2 is formed into a closed loop, that is, a bypass is provided between a rearmost one and a forwardmost one of winding units of the winder, then only if trays each having a package fitted thereon are supplied at random on the supply path, when there appears a vacant seat at the standby station on the tray path of one of winding units, one of the packages which are being circulated is thus automatically supplied to the winding unit.

Further, if the package supply path and the returning path are directly connected to a spinning frame so as to form a closed loop with the spinning frame, the supply path, the winder and the returning path, there is no need of storing packages produced on the spinning frame in a box to transport it to the storing station; only if an operator fits a package onto a tray when doffing on the spinning frame, secures an end of a yarn to the grip at an end of the yarn guide of the tray, and places the tray thus prepared for unwinding onto the supply path, supply of the package to and winding of a yarn on the winder can be thereafter effected automatically.

As apparent from the foregoing description, according to the present invention, a package transporting apparatus comprises a yarn guide disposed for up and down movement in a center hole of a peg of a peg tray which independently transports a package fitted and supported thereon, the yarn guide having a yarn grip provided at an upper end thereof so that a package and a tray may be transported in integral relationship with an end of a yarn on the package secured to the yarn grip. Accordingly, if a peg tray on which a large package is fitted is supplied to a winding unit and the yarn guide is protruded upwardly, then the yarn end is released by the yarn guide and is brought to a predetermined position at which it can be assuredly sucked into and grasped by a suction pipe which is waiting at a position above the package.

Thus, according to the package transporting apparatus of the present invention, only if packages fitted on peg trays are transported on a supply conveyor, they can be supplied to winding units which require new packages, thus without the necessity of provision of each of winding units with a magazine for storing large packages therein. Accordingly, the package transporting apparatus of the invention enables automatic guidance of an end of a yarn upon a yarn knotting operation in preparation for winding of the yarn.

Further, since a package can be transported independently by means of a peg tray, a surface of a yarn layer of the package will not contact with any other member, thereby preventing possible damage to the yarn layer.

What is claimed is:

1. A package transporting apparatus characterized in that a peg tray for independently fitting and supporting thereon a package to be transported on which a spun yarn is wound comprises a base plate, a peg extending erectly from the center of and secured to the base plate, and a yarn guide inserted for movement in a center hole of the peg said yarn guide having a yarn grip provided at an upper end thereof so that said peg tray may be transported with an end of a yarn on the package secured to said yarn grip.

2. A package transporting apparatus as claimed in claim 1, wherein said center hole of the peg extends from the top to the bottom end of the peg so that the yarn guide may be moved upwardly by means of compressed fluid jetted into the center hole from below the base plate.

3. A package transporting apparatus claimed in claim 2, wherein upper and lower end stoppers for stopping the yarn guide are secured adjacent the top and bottom ends of the center hole of the peg, respectively.

* * * * *